United States Patent [19]

Boggs et al.

[11] Patent Number: 4,464,923

[45] Date of Patent: Aug. 14, 1984

[54] METHOD AND APPARATUS FOR BENDING CORRUGATED PIPE

[76] Inventors: Samuel D. Boggs, 400 E. Randolph St., Chicago, Ill. 60601; Clement J. Miller, 525 S. East St., Crown Point, Ind. 46307

[21] Appl. No.: 343,436

[22] Filed: Jan. 28, 1982

[51] Int. Cl.[3] ..... B21D 7/00; B21D 7/14

[52] U.S. Cl. ..... 72/307; 72/369; 72/416; 72/481; 29/157 A

[58] Field of Search ..... 72/307, 306, 369, 384, 72/386, 385, 367, 481, 416; 29/157 A

[56] References Cited

U.S. PATENT DOCUMENTS

| | | | |
|---|---|---|---|
| 56,337 | 7/1866 | Fleetwood | 72/473 |
| 519,062 | 5/1894 | Hoell et al. | 72/307 |
| 1,517,678 | 12/1924 | Holub | 72/307 |
| 1,553,817 | 9/1925 | Holub | 72/307 |
| 3,670,553 | 6/1972 | Nothum et al. | 72/307 |
| 4,205,544 | 6/1980 | Foster | 72/307 |
| 4,249,405 | 2/1981 | Cyr | 72/307 |

FOREIGN PATENT DOCUMENTS

| | | | |
|---|---|---|---|
| 383325 | 3/1908 | France | 72/307 |
| 1484032 | 6/1967 | France | 72/307 |
| 512345 | 9/1939 | United Kingdom | 72/307 |

*Primary Examiner*—Daniel C. Crane

*Attorney, Agent, or Firm*—Silverman, Cass & Singer, Ltd.

[57] ABSTRACT

Thin-wall, corrugated pipe having alternating, annular ridges and valleys along its length is bent between a pair of die parts selectively to reform the normal configuration of a valley and change the linear distance between segments of a pair of ridges adjacent said valley thereby to form an incremental bend in the pipe. Thereafter, a predetermined number of incremental bends are formed in consecutive valleys to obtain a desired angle of bend. A radial angle fixture is engaged on one end of the pipe to determine and maintain the radial position of the pipe during the bending of the pipe, and a bend angle protractor is provided to determine precisely the angle to which the pipe is bent. The radial angle fixture further serves to maintain the pipe entering the bending tool perpendicular to the plane of the pair of dies.

62 Claims, 9 Drawing Figures

FIG. 1
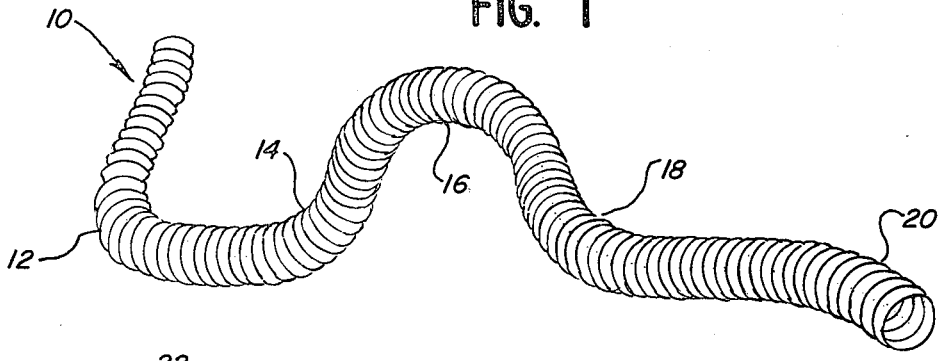
FIG. 2
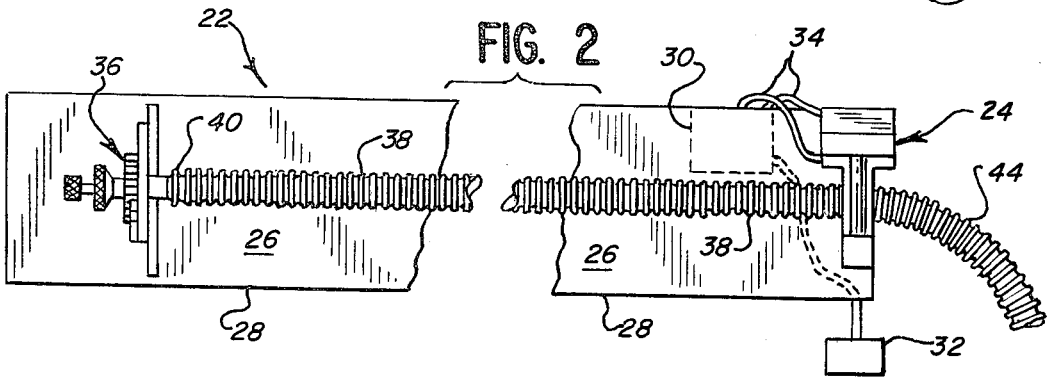
FIG. 4a
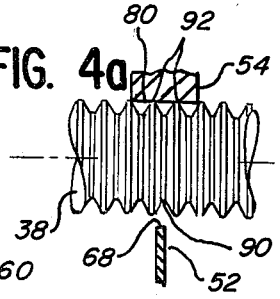
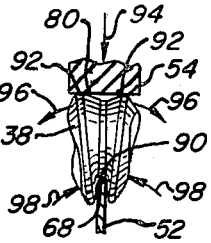
FIG. 4b
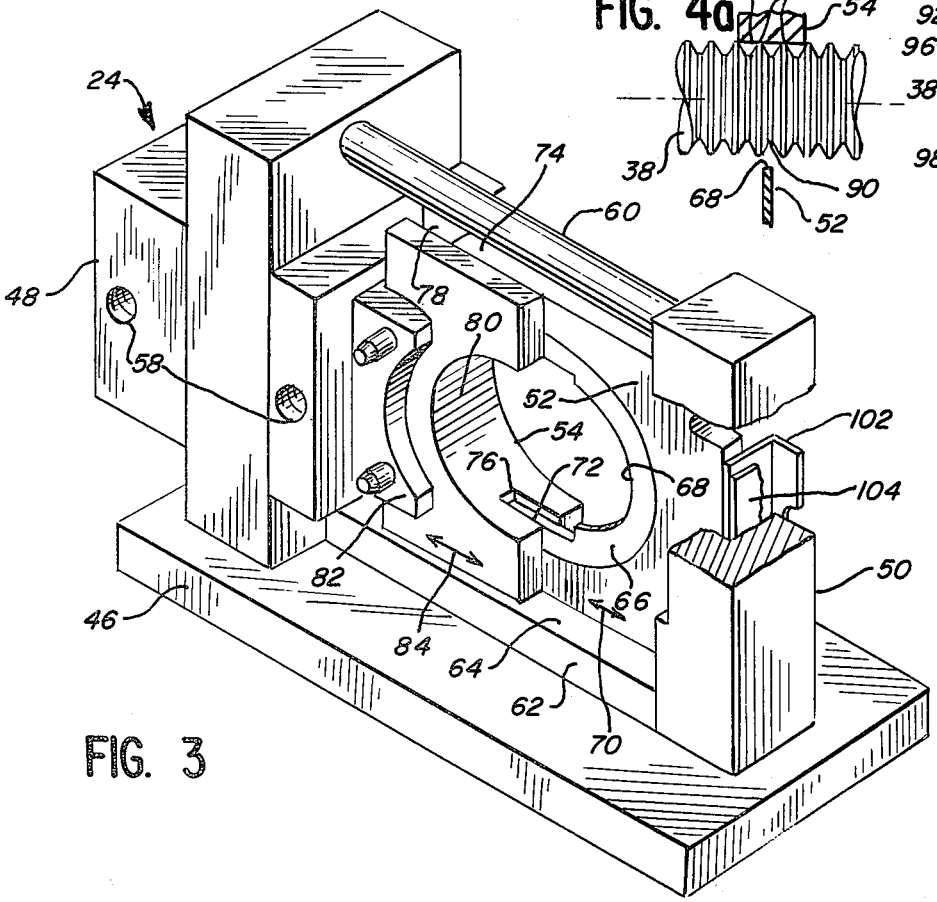
FIG. 3

METHOD AND APPARATUS FOR BENDING CORRUGATED PIPE

BACKGROUND OF THE INVENTION

This invention relates generally to bending metal pipe and more particularly, relates to bending relatively thin-walled corrugated metal pipe to selective angles along its length which enables its special application to automotive exhaust systems.

Heretofore, metal pipe has been bent mainly by a method employing so-called "brute force". The pipe is inserted between an arcuate, convex radius die and a pair of pivotally mounted and spaced apart back shoes. A hydraulic ram moves the radius die perpendicular to a line between the back shoes and against the pipe which, in turn, engages against the pair of back shoes. The radius die then is advanced to bend the pipe. The distance that the radius die is advanced or the depth of the bend then becomes the bend angle formed in the pipe. The radius of the bend is determined by the radius of arc of the die.

This "brute force" method functions by stretching the pipe wall material at the heel or outer radius of the bend and by compressing the wall material of the pipe at the throat or inner radius. Forming small radius bends in thick-walled, small diameter pipe in this manner presents a few problems. There is sufficient material in the pipe wall to provide for the stretching of the heel material while maintaining the pipe cross-sectional geometry. Essentially, the stretched pipe wall retains enough strength to maintain its configuration and not collapse or significantly deform. The throat material is strong enough not to buckle. Such is not the case, however, in bending thin-walled, large diameter pipe.

Thin-walled pipe is commonly referred to in the automotive industry as tubing and corresponds to pipe having a wall thickness of approximately 0.083 to 0.036 inch. Although presently this is the range commonly found for automotive-type pipe, it is contemplated that pipe wall thicknesses may be reduced even further to perhaps 0.012 to 0.014 inch using stainless steel material.

With so-called thin-walled, large diameter pipe, the pipe may have sufficient strength to maintain its configuration during the forming of large radius bends. However, for small radius bends, the thickness of the heel wall material is reduced due to the stretching beyond the point at which the pipe wall has the necessary strength to retain its shape. The heel of the pipe then collapses or flattens sufficiently to reduce the interior diameter of the pipe. The wall of the pipe at the throat may also distort, which may result in a resistance to the bending in the form of buckling of material thereat.

Substances such as sand or implements such as arbors have been known to be inserted on the interior of so-called thin-walled pipe prior to the bending operation so as to assist in maintaining the cross-sectional shape during formation of a small radius bend. However, these aids are not always feasible or usable, especially where multiple bends or reverse bends must be formed in the pipe.

Indeed, a need exists generally to be able to bend such thin-walled, large diameter pipe free from these problems. Further, in both O.E.M. automotive exhaust systems and after market replacements thereof, the need is acute because specially bent pipe configurations are required to be used or, in the after market replacement area, special configured out of stock or non-stock items must be provided quickly. Several different machines are commercially available which bend smooth-walled pipe by the described brute force method. These commercially available machines do not solve the problems described hereinabove.

Corrugated pipe has a structure that consists of annular ridges and valleys, the valleys being located between the ridges along the length of the pipe and may be likened to gussets. In a straight or unbent section of pipe, the ridges have their axes parallel to one another and perpendicular to the longitudinal axis of the pipe. The valleys represent the basic pipe diameter and the ridges represent the expanded outer diameter of the pipe. This results in development of a modulus of section that enables the thin-walled pipe to have rigidity and strength sufficient to maintain its configuration as well as to be bent to multiple angles required for application to automotive exhaust systems. Heretofore, the normal gauge for such corrugated pipe was approximately 20 gauge or 0.036 inch thick. It was contemplated that bending of such reduced wall thickness pipe in conjunction with corrugated configuration would facilitate such bending requirements. In practice, however, this advantage was not realized.

Such thin-walled, corrugated pipe has been used previously in the after market product field for exhaust and tail pipes. This thin walled, corrugated pipe heretofore has been bent in the conventional manner but for bending purposes, its thinner walls tend to aggravate the problems described hereinabove.

This invention provides a novel method and an apparatus for incrementally bending thin-walled corrugated pipe. Essentially, the configuration of the pipe wall at the valleys is reformed by bending, not stretching or compressing, to provide the desired bend angle. The desired bend angle of the pipe is achieved by incrementally deforming the pipe in one or more adjacent valleys. Forming a bend in such corrugated pipe by control bending of the gusset material at the valleys eliminates the undesired stretching and/or compressing of material where the brute force method was employed.

When such corrugated pipe is bent, the normal parallel relationship of the ridges is changed so that in the vicinity of the desired bend, the axes of the ridges are non-parallel one with respect to the other, but still perpendicular to the longitudinal axis of the pipe. Here, the linear distance between adjacent ridges at the heel of the bend is increased and the corresponding linear distance at the throat of the bend is decreased, resulting in a segmental arc or incremental bend.

SUMMARY OF THE INVENTION

To practice the method of this invention, a length of thin-walled, corrugated pipe at a location adjacent or relative to one end thereof is placed in a bending machine having a pair of forming dies. The female die has an arcuate seat dimensioned to engage a pair of adjacent annular ridges of the corrugated pipe. The male die has an arcuate seat dimensioned to engage the valley of the pipe intermediate said pair of ridges and at a location opposite the location at which the female die engages the ridges. The dies then are moved one toward the other to frictionally engage against the pair of ridges and intermediate valley concurrently, and thereafter, to exert the desired forming pressures sufficient to reform the normal configuration of the valley and change the spacing between the pair of adjacent ridges to realize an incremental bend. Thereafter, the bending procedure is repeated incrementally over a predetermined number of valleys and ridges which is directly related to the angle of the bend desired.

Further, during such sequential bending, the opposite or remote end of the pipe is rigidly retained in a novel fixture device whose axis is coaxial with the longitudinal axis of the pipe at all times. This fixture device is constructed to control the radial position of the pipe during such sequential bends. Also, said device includes a rotatable protractor to set the radial position of each incremental pipe bend and/or between sequential bends.

BRIEF DESCRIPTION OF THE DRAWINGS

FIG. 1 is a perspective view of a length of corrugated pipe in which multiple pipe bends have been formed at different radial positions relative to the longitudinal axis of the pipe, including a reverse bend;

FIG. 2 is a plan view of apparatus embodying the invention having a length of corrugated pipe installed therein and showing a pipe bend formed by the apparatus.

FIG. 3 is a perspective view of a novel bending tool of the apparatus of the invention;

FIG. 4A is a top view, partially in section, of a length of corrugated pipe positioned within the female and male dies of said bending tool before bending;

FIG. 4B is a view similar to FIG. 4A and showing movement of the female and male dies to effect an incremental bend.

DESCRIPTION OF THE PREFERRED EMBODIMENT

Figure 5:
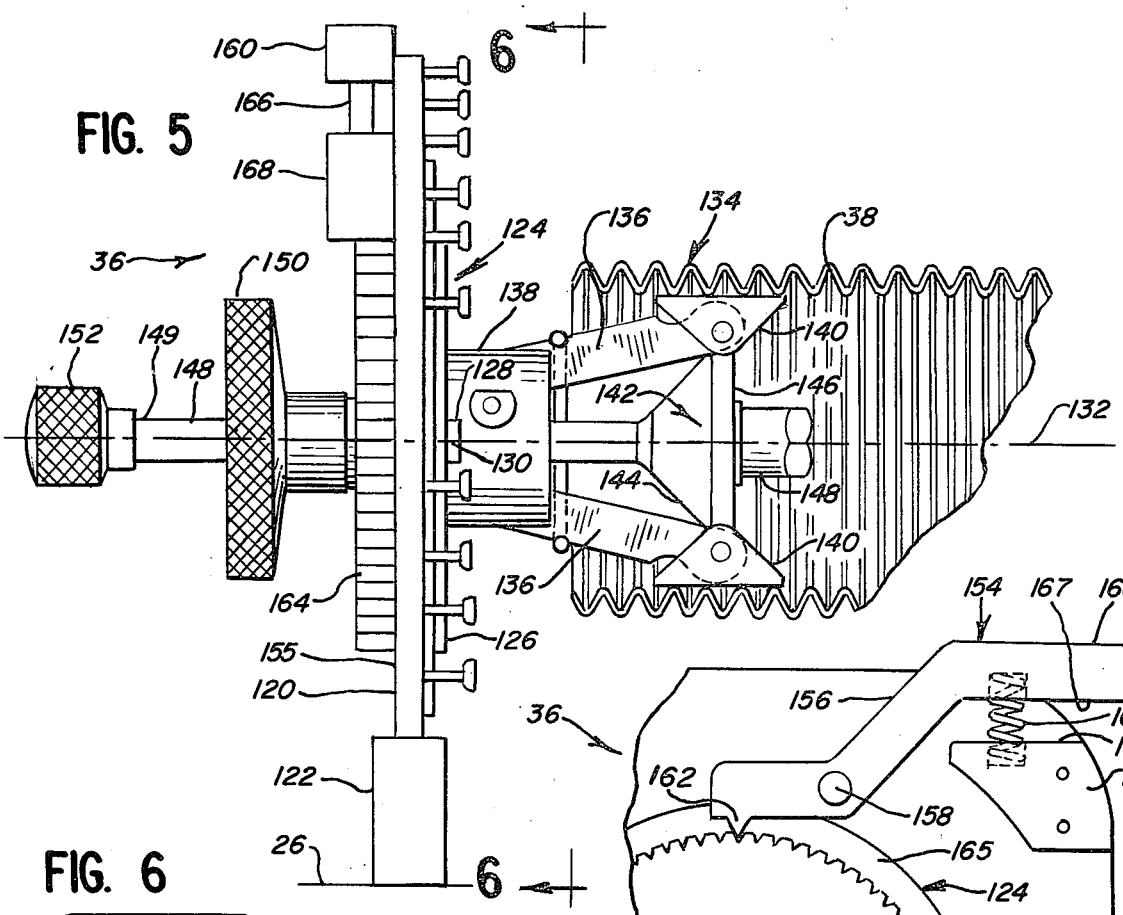
FIG. 5 is a side elevational view illustrating the novel radial angle fixture of said apparatus having jaws engaging the remote end of a length of corrugated pipe which is shown in section.

Referring now to FIG. 1, there is illustrated a length of thin-walled corrugated metal pipe indicated generally by the reference character 10. As illustrated, such corrugated pipe 10 used herein has a wall thickness of approximately 0.36 inch or equivalent to 20 gauge metal tubing commonly used in automotive exhaust system applications. The corrugation ridges are uniformly formed along the pipe at substantially a certain distance such as at ⅝ inch on center. Alternating annular ridges and valleys are formed therein such as by expanding the pipe from the interior thereof to form the ridges. The nominal outside diameter of said pipe is the outside diameter at the valleys. Corrugated pipe 10 has several bends 12, 14, 16, 18 and 20 formed therein at different radial positions as viewed along the longitudinal axis of pipe 10. As may be seen, bend formations 14, 16 and 18 present what may be termed a "reverse bend" which heretofore has been very difficult to form in any pipe, and especially, in corrugated pipe, such as 10.

Certain terms as hereinafter used, are defined. A "bend angle" means the angle at which the pipe is bent along a segment of the pipe. The two sides of the bend angle are provided by the reformed valley configurations of the pipe on opposite sides of the apex of said bend angle. A "radius of pipe bend" means that distance from the center of an arc describing the bend angle to the central longitudinal axis of the pipe in that bend formation or angle. A "radial position" means the relative rotational location between bend angles along the length of a corrugated pipe, i.e., the degree of rotation around the longitudinal axis of the unbent portion of the pipe retained in the radial angle fixture. Any marker may be selected, arbitrarily, to serve as a reference; and, thereafter, all radial angles are determined relative to that selected marker. The terms "bend angle", "radius of pipe bend" and "radial position" are terms commonly used in the field of pipe bending.

In FIG. 2, bending apparatus embodying the invention is indicated generally by the reference character 22. Apparatus 22 includes a bending tool 24 resting on the flat top surface 26 of a table 28, for instance. Below table 28 is a hydraulic power source 30, indicated in dashed lines. Extending from the hydraulic power source 30 is the foot pedal switch 32 for controlling the source 30 and hydraulic lines 34 for supplying hydraulic power to the bending tool and for returning hydraulic fluid to the source 30.

Also arranged on surface 26 is a radial angle fixture 36 which is free to slide longitudinally and laterally of the surface 26. A length of corrugated pipe 38 is inserted in apparatus 22 for formation of bends in the pipe. One end 40 of the corrugated pipe 38 is engaged upon an engagement mechanism of radial angle fixture 36 while the other end 42 of corrugated pipe 38 extends through bending tool 24.

In FIG. 2, the length of corrugated pipe 38 between the bending tool 24 and end 42 has been reformed to provide a bend formation 44 therein. The length of corrugated pipe 38 between the bending tool 24 and the radial angle fixture 36 substantially is straight which is the initial condition of the pipe when placed in the bending apparatus.

Bending tool 24, illustrated in FIG. 3, comprises a base 46 upon which is mounted a body 48, an end block 50, and a pair of mating dies identified as male die 52 and female die 54. In the preferred embodiment, base 46 is fixed upon the top surface 26 of table 28. Alternatively, bending tool 24 may be carried by means other than table 28.

Body 48 is fixed to base 46 and provides for the mounting of movement means of the dies such as a hydraulic cylinder therein or thereat. Openings 58 provide tapped holes into which the fittings for the hydraulic lines 34 may be secured. End block 50 is fixed to base 46 and is secured to body 48 by rod 60. Member 62 has a hardened top surface 64 providing a wear plate for the lower surfaces of dies 52 and 54. The combination of body 48, block 50, rod 60 and base 46 provide structure within which a force may be applied to a length of corrugated pipe located between the dies when the male and female dies are moved together.

Male die 52 is formed of a flat, narrow, plate-like body presenting a tapered structure 66 narrowing down to an arcuate, half cylindrical surface seat 68 having a width substantially less than the certain distance between the pipe ridges. Seat/extends along a second axis and its width is measured along the second axis. Male die 52 is slidably mounted in block 50 and is able to reciprocate in the two directions indicated by arrow 70.

Lateral stability for male die 52 is provided by a tongue and slot arrangement with female die 54 in which the left-hand portions of the male die form tongues 72 and 74 which mate with slots 76 and 78 of female die 54, respectively centrally locating the width of seat 68 relative to the width of seat 80.

Female die 54 is formed of a thick, plate-like body having an arcuate, half cylindrical surface seat 80 formed therein facing seat 68. Seat 80 has a width of substantially the certain distance between the ridges. Seat 80 extends along a first axis parallel to the second axis and the width of seat 80 is measured along the first axis. Female die 54 is secured to a coupling 82 that, in turn, is driven reciprocally by the movement means, such as the ram of a hydraulic cylinder contained in body 48. The female die 54 thus is reciprocally driven in the directions indicated by the arrow 84.

The movement means may be other than hydraulic and the description of a hydraulic cylinder is not to be construed as limiting the invention. The main requirements for the movement means are that they provide sufficient force to the dies for bending the pipe and provide clearance for 180° bend angles.

In FIG. 4*a*, a section of the pipe 38 is positioned between the male die 52 and the female die 54. The arcuate seat 68 of the male die is aligned with an annular valley 90 of the pipe 38. The arcuate seat 80 of the female die 54 is arranged aligned over at least two annular ridges 92 on either side of the annular valley 90. This is the position of the pipe 38 relative to the dies of the bending tool 24 just prior to an incremental bend being formed in the pipe 38.

FIG. 4*b* illustrates the position of the dies during the formation of an incremental bend in the pipe 38. Female die 54 is moved by the hydraulic ram in the direction indicated by arrow 94. The arcuate seat 80 of the female die 54 engages against the two annular ridges 92 and moves a diametrically opposed segment of the annular valley 90 into engagement with the arcuate seat 68 of male die 52. Continued force applied by the hydraulic ram further moves the female die 54 towards the male die 52 so that the pipe 38 is reformed by the male and female dies. Adjacent the female die 54, a segment of the corrugated pipe 38, also known as the heel, is flattened to move the ridges 92 away from one another in the directions indicated by the arrows 96. Adjacent the male die 52, a segment of the annular valley 92, also known as the throat, is deepened and the annular ridges 92 are brought closer together in the directions indicated by the arrows 98. This develops a segment arc of a bend angle. The dies may be moved one relative to the other by movement of an individual die or both dies.

The linear distance between the apices of adjacent ridges is changed by bending the gusset material in the valley between the ridges. At the throat, the linear distance between apices is decreased, and at the heel, the linear distance between the apices is increased. It should be noted that the internal area of the pipe at the bend is not adversely changed. In fact, only the longitudinal axis along the bend has been shifted.

The segment arc of the bend angle developed by one stroke of the dies is approximately six (6) degrees at a bend radius of five (5) inches. A bend angle which is larger than approximately six degrees is formed by causing the dies to engage against the pipe in several successive valleys and ridges, there being as many segment arcs of the bend formed as are necessary to form the desired bend angle. For example, a sixty degree bend angle of the corrugated pipe would require about ten successive segment arcs. Thus, each bend angle may be thought of as being formed by one or more segment arcs of a fixed number of degrees.

Bend angles other than those evenly divisable by six degrees are effected by partial formation of a segment arc.

The invention is not limited to the recited dimensions for pipe 10. Accordingly, corrugated pipe having different axial spacing of annular ridges and different internal diameters can be bent using appropriate segment arcs for achieving desired bend angle for such pipe of different dimensions.

Bend formations may be formed in the corrugated pipe with different radii of bends. This is provided for by inserting different numbers of spacer keys between the rear of the male die 52 and the end block 50. In FIG. 3, two spacers or keys 102 and 104 are illustrated so positioned. The two spacer keys will provide a radius of bend which is about three inches; one spacer key will provide a radius of bend which is about four inches; and no spacer key will provide a radius of bend which is about five inches. A smaller radius of bend provides more degrees of segment arc than a larger radius of bend.

Figure 8:
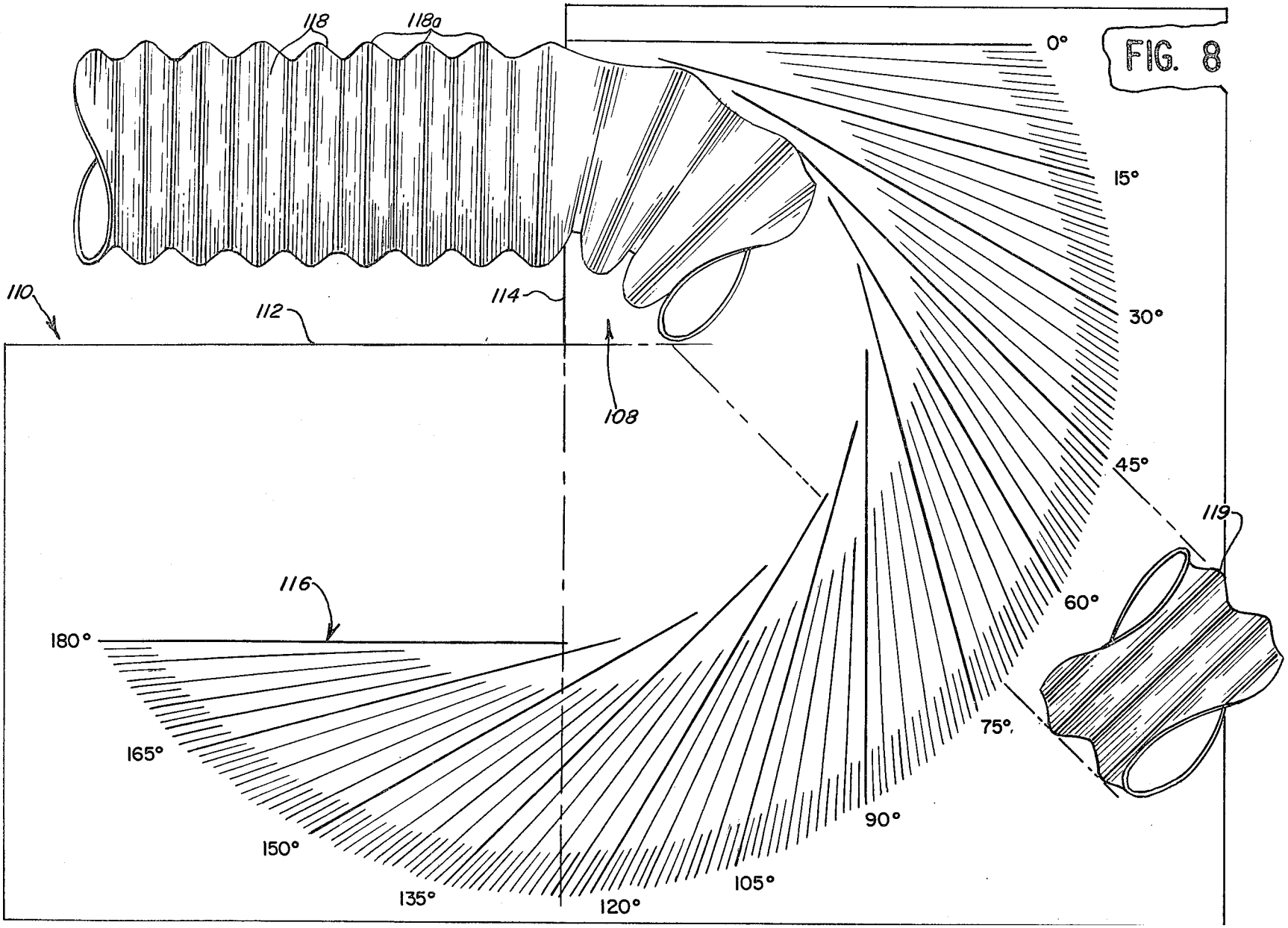
FIG. 8 is a plan view of a novel bend angle protractor provided for use with the bending tool to indicate the bend angle formed in a corrugated pipe by said tool.

In FIG. 8, a bend angle protractor is indicated generally by the reference character 110. The protractor 110 comprises a clear plastic sheet 112 which is shaped to provide an edge 114 which abuts the dies of the bending tool 24. On plastic sheet 112 are marked angular graduations 116, for example, from 0° to 180°. One protractor 110 is provided for each different bend angle radius, for example of three inches, four inches and five inches. The outer edges of sheet 112 may be configured to provide for ease of handling.

To measure a bend angle, the graduations 116 of the protractor 110 are located so that the 0° graduation is aligned in registry with apices of the pipe, such as the apices 118*a* of the ridges 118 of the corrugated pipe 38 on one side of the bend angle 108. The pipe then is rotated so that the portion of the pipe extending from the other side of the bend angle overlays on the graduations. The bend angle then can be read by sighting over the apices of the distal portion of the pipe, such as the outer surface 119 of the pipe distally of the bend 108 and an assisting instrument for avoiding parallax error, not shown, may be employed. In the example illustrated in FIG. 8, the bend angle is about 45° and appears to have been obtained by means of two segment arcs with each arc providing about 22½° of bend. This is much larger than is typically obtained in the working embodiment of the invention. Therefore, it will be understood that FIG. 8 is illustrative only of how the bend angle protractor is used.

Thus, it has been shown how a bend angle is formed in the corrugated pipe 38, with such bend angle also having been referred to as a bend formation. Now it will be explained how these bend formations are made at varying radial positions of the corrugated pipe 38.

Figure 6:
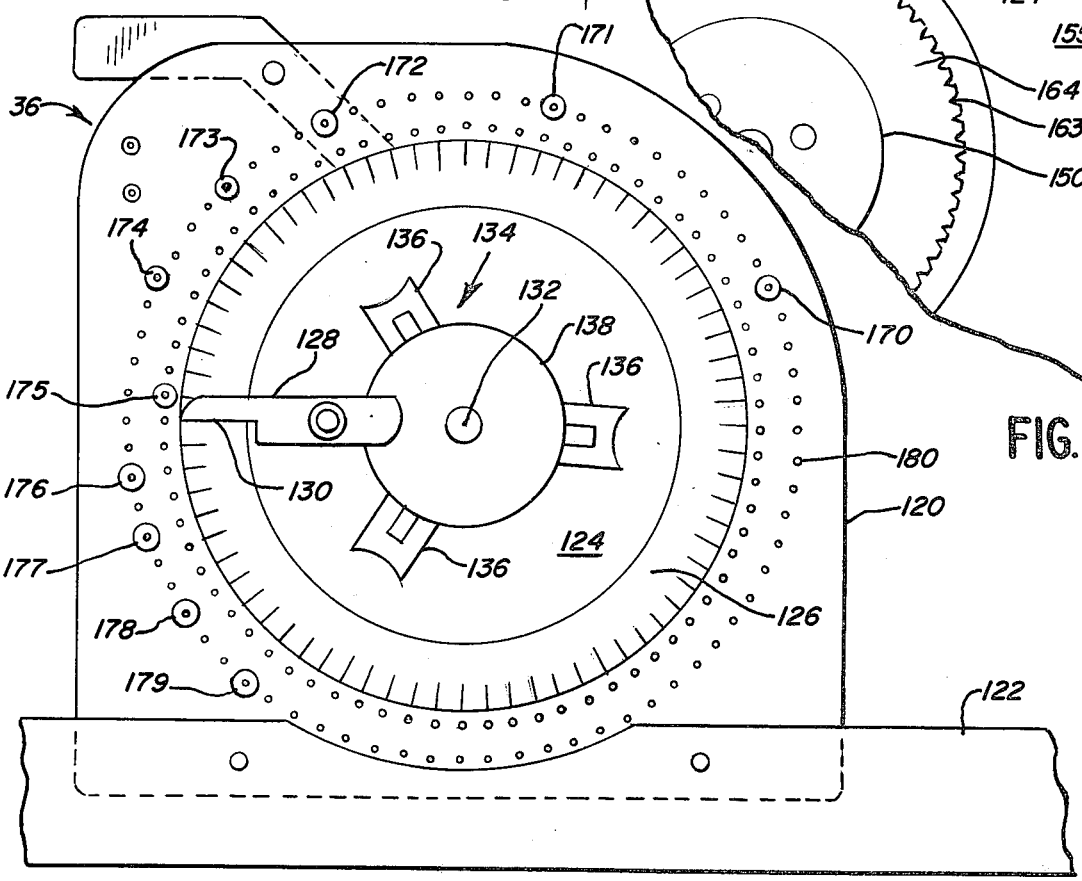
FIG. 6 is a front elevational view of said radial angle fixture taken along the line 6—6 of FIG. 5 and in the direction indicated generally.
Figure 7:
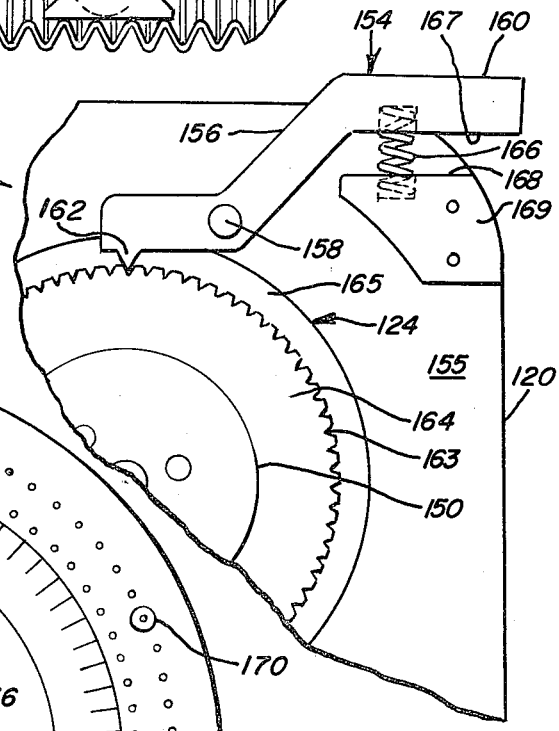
FIG. 7 is a partial, rear elevational view of said radial angle fixture and illustrating a detenting mechanism thereof.

In FIGS. 5, 6 and 7 there is illustrated a radial angle fixture 36 embodying the invention. Fixture 36 includes a plate 120 and a base 122. The bottom surface of base 122 is slidably installed on the flat, top surface 26 of table 28 so that fixture 36 will be free to slide thereon.

Fixture 36 includes a protractor disc 124 arranged in a circular cut-out of the plate 120. The protractor disc 124 has a front face 126 upon which angle graduations are marked, and further, includes an indicator arm 128 providing an indicating surface 130 which, if extended, would pass through the longitudinal axis of a length of corrugated pipe 38 retained by the radial angle fixture 36. In FIG. 5, the longitudinal axis 132 of the pipe 38 may be seen to be coaxial with the longitudinal axis of the radial angle fixture 36.

On the front side of the fixture 36 extends a mechanism 134 for fixedly engaging the pipe 38. This engagement mechanism 134 includes linkages 136 pivotally mounted at one end thereof to a central body 138 which, in turn, is fixed on the front face 126 of the disc protractor 124. The other ends of the linkages 136 carry jaws 140 which can be inserted into the interior of pipe 38 and are moved against the interior circumference of the corrugated pipe 38 by a cone-shaped wedge 142 having a sloped surface 144 and a base 146.

Wedge 142 is rotably mounted on one end of shaft 148 but is fixed in position relative to the length of shaft 148. Shaft 148 extends through body 138, the disc protractor 124 and a setting knob 150 from which it protrudes. The end 149 of shaft 148 carries a knob 152 fixed thereon and the length of shaft 148 from knob 152 through body 124 is externally threaded. Setting knob 150 is fixed to the disc protractor 124 on the rear face thereof and has internal threads which engage the external threads of shaft 148. By manually rotating the setting knob 150 relative to rotating knob 152, the shaft 148 along with wedge 142 may be moved relative to the disc protractor 124 with the sloped face 144 of wedge 142 moving the jaws 140 respectively into and out of engagement, with the inner circumference of the corrugated pipe 38. This holds the pipe securely and effectively fixes it relative to the position of the radial angle fixture 36 and, in particular, the angular position of the disc protractor 124.

The disc protractor is fixed in its angular position by a detenting mechanism 154 carried on the reverse side 155 of plate 120, as best illustrated in FIG. 7. Detenting mechanism 154 includes a lever 156 which is pivotally mounted to plate 120 by pin 158. One end of lever 156 forms a handle 160, while the other end of lever 156 provides a detenting tooth 162. Detenting tooth 162 is positioned to engage the teeth 163 of a gear wheel 164 fixed on the rear face 165 of the disc protractor 124. When the detenting tooth 162 is engaged in one of the teeth of the gear wheel 164, rotation of gear wheel 164 is prevented. Detenting tooth 162 normally is biased toward engagement with the teeth of gear wheel 164 by a compression spring 166 acting against the lower surface 167 of handle 160 and an upper surface 168 of a spring support 169 fixed on the side 155 of the plate 120. The teeth 163 of wheel 164 provide desired angular degree increments for protractor 126.

Radial angle fixture 36 further includes a series of memory pins 170 through 179 received in locating sockets, such as holes 180. Holes 180 are arranged in two concentric circles around the parametric edge of the disc protractor 124. Each of these memory pins 170 through 179 may carry one of a series of numbers thereon to indicate the radial position to which the pipe 38 is to be rotated for selectively forming each bend angle progressively. Thus, fixture 36 may be used advantageously to establish a sequence or program for radial positioning of selected bend angles.

For example, the first bend angle is to be formed at a radial position of the pipe 38 which is indicated by memory pin 170. The handle 160 of detenting mechanism 154 is depressed to disengage the detenting tooth 162 from the teeth of gear wheel 164 and the knob 150 is rotated to bring the reading surface 130 of indicator arm 128 in line with memory pin 170. The desired bend angle then is formed in the pipe 38 with the radial angle fixture 36 moving across the top surface 26 of table 28 as the several segmental arcs are bent. This maintains the pipe 38 at the proper radial position throughout the angular length of the bend angle. The handle 160 then is depressed again and the pipe 38 is rotated by manually rotating knob 150 so that the reading surface 130 now is in line with the next memory pin 175 which identifies the next radial position at which a bend angle is to be formed. The bend angle then is formed over a length of the pipe with the fixture 36 maintaining the proper radial position and the process of rotating the pipe to the next desired radial position is repeated. It will be understood that the desired radial positions may not necessarily be in sequence around the disc protractor; in many instances, they probably are out of sequence. It further will be understood that the bending tool 24 forms the bend formations at only one radial position and therefore, the pipe 38 must be rotated by the radial angle fixture or be rotated relative thereto in order to obtain bend angles in more than one radial position.

The entire bend angle is formed with the pipe at the same radial position. This forms a bend angle in a plane parallel to the surface 26 of table 28. It is possible with the present invention to form a bend angle in more than one plane, and in particular, a series of planes. This is obtained by changing the radial position of the pipe between formations of the incremental bends resulting in the desired bend angle. Thus, a bend angle may start in one plane, or at one radial position, and progress through several planes or radial positions during completion of that bend angle. Thus, the radial position of segmental arcs may follow a helix-like path around the outside of a cylinder, if the radius of bend is maintained constant, or around the outside of a cone, if the radius of bend also is altered.

It will be noted that during bending of pipe 38, the longitudinal axes of the bending tool 24, pipe 38 and radial angle fixture 36 relative to the horizontal plane of surface 26 of the table 28 are in registry or coaxial. By this is meant, the axial centers of the tool 24, pipe 38 and fixture 36 always coincide even while the fixture 36 may move laterally relative to the tool 24 or in a direction linearly toward the tool 24. Thus, it will be appreciated that as the fixture 36 moves during bending of pipe 38 on table surface 26, the longitudinal axes or axial centers of the tool, pipe and fixture always remain a fixed distance spaced above the table surface 26. Therefore, they remain in registry or are coaxial during bending of the pipe. This is to insure that during the bend forming cycle, the total angle bend is maintained on one plane which is parallel to the plane of the table surface 26 so long as the radial position is not changed during the bending cycle. Further, the plane of the radial position of a particular bend relative to the plane of the table may be changed by rotating the pipe in the fixture without changing the orientation of the longitudinal axis of the pipe relative to the axial centers of the bending tool and radial fixture.

Concerning the bending tool 24, typically, the seat 68 of the male die 52 has a width of about 0.070 or 1/16 of an inch. This is believed to be an optimum dimension for thin-walled corrugated pipe having a nominal pipe diameter of about two inches with ridges formed therein at about one half inch spacings. For this size corrugated pipe, which typically has a wall thickness of 0.036 inches, the compression portion of the stroke of the female die is about 3/16 of an inch while the entire stroke is about 7/16 of an inch to provide clearance for longitudinal movement of the pipe 38. Typically, one segmental arc bend can be formed in one to two seconds. These specifications can be varied within the purview of this invention relating to the pipe specifications.

The invention provides not only for simple bends such as bend angles 12 and 20 illustrated in FIG. 1, but also for reverse and multiple bends, such as bend angles 14, 16 and 18 illustrated in FIG. 1. Such multiple and reverse bends in exhaust pipes, for instance, are for clearing obstructions, such as, the rear axle in an automotive exhaust system. The invention enables multiple and reverse bends to be realized in such pipe simply by rotating the pipe to the proper radial position as the desired bend angle is formed in the pipe.

Thus, a bend angle of 180° and a radius of bend of three inches may be formed with the end 42 of the pipe spaced from end block 50. The pipe then may be rotated through a 180° radial angle and still clear body 48 so that a reverse bend 16 may be formed in the pipe 38.

The dimensions and specification details of the bending tool 24, the radial angle fixture 36 and the bend angle protractor 116 may all be modified without departing from the fundamental principles of their operation together in the apparatus 22. It is intended that the claims hereto appended be construed broadly commensurate with the progress in the sciences contributed by the herein invention.

What is claimed is:

1. A method of incrementally bending a length of pipe to a desired bend angle, in which the pipe has corrugations providing alternating, annular valleys and ridges spaced along the length thereof, the method comprising the steps of:

A. providing a bending tool arranged to receive the pipe therein having a pair of cooperating dies located on opposite sides of the pipe for grasping the pipe solely on the outside of the pipe, one of said dies having an arcuate seat arranged to engage a pair of adjacent ridges at the heel of the bend angle and the second die having an arcuate seat arranged to engage the valley intermediate said pair of ridges at the throat of the bend angle;

B. moving said dies one relative to the other so as to functionally engage only said pair of ridges and said intermediate valley concurrently and move them relative one another a distance sufficient to reform the normal configuration of said valley and change the linear distance between portions of said pair of ridges to effect a segmental arc bend thereat, C. repeating said step B over a number of consecutive valleys and ridges directly related to the desired bend angle.

2. A method of providing a desired bend angle in a length of corrugated pipe having first and second ends and alternating, annular ridges and valleys spaced along that pipe length between said ends, said method comprising the steps of:

(A) engaging said pipe length between a pair of cooperating bending dies in the vicinity of the first end with at least one pipe end spaced above a planar support surface, said bending dies being on opposite sides of the corrugated pipe for grasping the pipe solely on the outside of the pipe, (1) one bending die having an arcuate seat engaging only a pair of adjacent ridges at the heel of the bend and the second die having an arcuate seat engaging only the valley intermediate said pair of ridges in opposing relationship to the one die at the throat of the bend;

(B) moving said dies one relative to the other so as concurrently to reform the configuration of the valley and change the linear spacing between said adjacent ridges to effect a segmental arc bend thereat; and (C) effecting additional segmental arc bends, where necessary, over a consecutive sequence of valleys and ridges of said pipe length directly related to the desired bend angle.

3. The method of claims 1 or 2 in which moving said dies includes moving said dies the same distance for each segmental arc bend to obtain equal angular segmental arc bends and a desired bend angle of one radius.

4. The method of claims 1 or 2 in which moving said dies includes moving said dies different distances for each segmental arc bend to obtain different angular segmental arc bends and a desired bend angle of different radii.

5. The method of claims 1 or 2 in which moving said dies includes moving one die toward the other while maintaining the other die stationary, the dies being diametrically opposed to one another.

6. The method of claims 1 or 2 which includes moving said dies hydraulically.

7. The method of claim 1 in which the pipe has opposed ends and the bending tool receives the pipe therein in the vicinity of the first end with the pipe second end being spaced above a planar support surface.

8. The method of claims 2 or 7 further including maintaining said pipe ends equally spaced above the plane of said support surface while the segmental arc bend is effected.

9. The method of claim 2 or 7 including slidably retaining the pipe second end above said support surface.

10. The method of claims 2 or 7 further including maintaining the pipe second end spaced above the support surface substantially the same distance as the distance from the portion of the pipe engaged in the dies to the plane of the support surface.

11. The method of claims 1 or 2 in which moving said dies includes bending segments of said pipe between ridges to reform the configuration of the valley.

12. The method of claim 11 in which bending segments of said pipe includes increasing the linear distance between ridges at the heel of the segmental are bend and decreasing the linear distance between ridges at the throat of the segmental arc bend.

13. The method of claims 1 or 2 further including controlling the radial position of the pipe around its longitudinal axis while effecting a segmental arc bend.

14. The method of claim 13 in which controlling the radial position of the pipe includes fixing the radial position of the pipe over consecutive segmental arc bends to form the desired bend angle in one plane.

15. The method of claim 13 in which controlling the radial position of the pipe includes changing the radial position of the pipe over consecutive segmental arc bends to form the desired bend angle in more than one plane.

16. The method of claims 1 or 2 including forming at least a pair of said bend angle formations spaced apart along said pipe length by means of such segmental arc bending of the pipe.

17. The method of claim 16 in which moving said dies includes moving said dies one distance for each segmental arc bend of a bend angle and moving said dies another distance for each segmental arc bend of another bend angle to obtain different radii for each bend angle.

18. The method of claim 16 further including controlling the radial position of the pipe around its longitudinal axis during effecting a segmental arc of bend by maintaining the radial position of the pipe while forming each bend angle and changing the radial position of the pipe for each bend angle.

19. The method of claim 2 or 7 including forming at least a pair of bend angles spaced apart along said pipe length by means of such segmental arc bending of the pipe and further including slidably retaining the second pipe end above said support surface.

20. The method of claims 1 or 2 further including measuring the bend angle by providing a bend angle protractor having angle graduations arranged tangential to an arc of a circle, the radius of the segmental arc bend being equal to the radius of the circle, overlying the pipe in the vicinity of the bend angle on the protractor and sighting the angle graduations over the pipe.

21. A method of providing a desired bend angle in a length of corrugated pipe having first and second ends and alternating, annular ridges and valleys spaced along the pipe length between said ends, said method comprising the steps of:

(A) engaging said pipe length between a pair of cooperating bending dies in the vicinity of the first end with the pipe ends spaced above a planar support surface, said pair of dies being located on opposite sides of the corrugated pipe for grasping the pipe solely on the outside of the pipe, one bending die having an arcuate seat engaging only a pair of adjacent ridges at the heel of the bend angle and the second die having an arcuate seat engaging only the valley intermediate said pair of ridges in opposing relationship to the one die at the throat of the bend angle;

(B) maintaining the pipe second end spaced above the support surface;

(C) controlling the radial position of the pipe around the longitudinal axis of the pipe;

(D) moving said dies one relative to the other so as concurrently to reform the configuration of the valley and change the linear spacing between said adjacent ridges to effect a segmental arc bend thereat; and (E) effecting additional segmental arc bends, where necessary, over a consecutive sequence of valleys and ridges of said pipe length directly related to the desired bend angle.

22. The method of claim 21 in which moving said dies includes moving said dies the same distance for each segmental arc bend to obtain equal angular segmental arc bends and a desired bend angle of one radius.

23. The method of claim 21 in which moving said dies includes moving said dies different distances for each segmental arc bend to obtain different angular segmental arc bends and a desired bend angle of different radii.

24. The method of claim 21 in which moving said dies includes moving one die toward the other while maintaining the other die stationary, the dies being diametrically opposed to one another.

25. The method of claim 21 including moving said dies hydraulically.

26. The method of claim 21 in which maintaining the pipe second end spaced above the support surface includes maintaining said pipe ends equally spaced above the plane of said support surface while the segmental arc bend is effected.

27. The method of claim 21 in which maintaining the pipe second end spaced above the support surface includes slidably retaining the pipe second end spaced above said support surface.

28. The method of claim 21 in which maintaining the pipe second end spaced above the support surface includes maintaining the pipe second end spaced above the support surface substantially the same distance as the distance from the portion of the pipe engaged in the dies to the plane of the support surface.

29. The method of claim 21 in which moving said dies includes bending segments of said pipe between ridges to reform the configuration of the valley.

30. The method of claim 29 in which bending segments of said pipe includes increasing the linear distance between ridges at the heel of the segmental arc bend and decreasing the linear distance between ridges at the throat of the segmental arc bend.

31. The method of claim 21 in which controlling the radial position of the pipe includes fixing the radial position of the pipe over consecutive segmental arc bends to form the desired bend angle in one plane.

32. The method of claim 21 in which controlling the radial position of the pipe includes changing the radial position of the pipe over consecutive segmental arc bends to form the desired bend angle in more than one plane.

33. The method of claim 21 including forming at least a pair of said bend angles spaced apart along said pipe length by means of such segmental arc bending of the pipe.

34. The method of claim 33 in which moving said dies includes moving said dies one distance for each segmental arc bend of a bend angle and moving said dies another distance for each segmental arc bend of another bend angle to obtain different radii for each bend angle.

35. The method of claim 33 in which controlling the radial position of the pipe around its longitudinal axis includes maintaining the radial position of the pipe while forming each bend angle and changing the radial position of the pipe for each bend angle.

36. The method of claim 21 further including measuring the bend angle by providing a bend angle protractor having angle graduations arranged tangential to an arc of a circle, the radius of the bend angle being equal to the radius of the circle, overlying the pipe in the vicinity of the bend angle on the protractor and sighting the angle graduations over the pipe.

37. The method of claims 1, 2 or 21 in which moving said dies includes moving said dies the same distance into the pipe section for each segmental arc bend to obtain equal angular segmental arc bends and a desired bend angle of one radius.

38. The method of claims 1, 2 or 21 in which moving said dies includes moving said dies different distances into the pipe section for each segmental arc bend to obtain different angular segmental arc bends and a desired bend angle of different radii.

39. An apparatus for providing a bend angle in a length of corrugated pipe having first and second ends and alternating, annular ridges and valleys spaced along that pipe length between said ends, successive ridges being uniformly formed along the pipe at substantially a certain distance, said apparatus comprising:

a die set consisting of a pair of cooperating bending dies arranged on opposite sides of the corrugated pipe to receive therein the pipe length in the vicinity of the first end and for grasping the pipe only on the outside of the pipe, the first bending die having a pipe engaging surface that is only an arcuate, half cylindrical surface seat extending along a first axis, which has a width, as measured along said first axis, of substantially said certain distance, engagable only with a pair of adjacent ridges at the heel of the bend angle and the second die having an arcuate, half cylindrical surface seat extending along a second axis parallel to said first axis, which has a width, as measured along said second axis, substantially less than said certain distance and is centrally located relative to said width of said first bending die seat, engagable only with the valley intermediate said pair of ridges in opposing relationship to the one die at the throat of the bend angle; and movement means for moving the dies one relative to the other so as functionally to engage the pipe length between the pair of dies and concurrently to reform the configuration of the valley and change the linear spacing between said adjacent ridges to effect a segmental arc bend thereat;

the segmental arc bends being effected, where necessary, over a consecutive sequence of valleys and ridges of said pipe length directly related to the desired bend angle.

40. The apparatus of claim 39 in which said pair of dies are retained in a body, one of the pair of dies is fixed relative to the body and the other die is moved by the movement means relative to the body and one die, the dies being diametrically opposed to one another.

41. The apparatus of claim 40 in which there is at least one spacer key that is selectively insertable in and removable from between said one die and body to determine the distance that the pair of dies are moved by the movement means and thereby the radius of the segmental arc of bend, when said spacer key is inserted, said dies forming one radius of the segmental arc bend and when removed, said dies forming another radius of the segmental arc bend.

42. The apparatus of claim 39 in which said movement means include a hydraulic ram moving the dies one relative to the other.

43. The apparatus of claim 39 further including a planar support surface extending substantially perpendicular from said pair of dies.

44. The apparatus of claim 43 further including fixture means retained on said support surface and engaging said pipe length at said second end, said fixture means for maintaining the pipe second end spaced above the support surface and for controlling the radial position of the pipe length around the longitudinal axis of the pipe while the segmental arc bend is effected.

45. The apparatus of claim 44 in which the fixture means are slidably retained on said support surface.

46. The apparatus of claim 44 in which the fixture means maintain the pipe second end spaced above the support surface substantially the same distance as the distance from the portion of the pipe engaged in the pair of dies to the plane of the support surface.

47. The apparatus of claim 44 in which the fixture means maintain the pipe ends equally spaced above the plane of said support surface while the segmental arc bend is effected.

48. The apparatus of claim 44 in which the fixture means include radial protractor means for controlling the radial position of the pipe.

49. The apparatus of claim 48 in which said radial protractor means include a disc protractor carrying an indicator member of the radial position of the protractor and thereby the pipe length, memory pins arrangeable around the protractor in at least one concentric circle for indicating the radial positions of the pipe length at which segmental arcs of bend are to be effected, and gear and lever means for selectively fixing the radial position of the disc protractor.

50. The apparatus of claim 39 further including bend angle protractor means abutted against a side of said pair of dies adjacent the first end of said pipe, said protractor means having angle graduations arranged tangential to an arc of a circle passing through said pair of dies, the radius of the segmental arc bend being equal to the radius of the circle and the graduations being sightable over the pipe length, the bend angle protractor means being for determining the degree of the bend angle.

51. An apparatus for providing a bend angle in a length of corrugated pipe having first and second ends and alternating, annular ridges and valleys spaced along that pipe length between said ends, said apparatus comprising:

a bending tool arranged to receive therein the pipe in the vicinity of the first end, said bending tool comprising a die set consisting of a pair of cooperating bending dies on opposite sides of the corrugated pipe for grasping the pipe only on the outside of the pipe and movement means, the first die having an arcuate seat engagable with only a pair of adjacent ridges at the heel of the bend angle and the second die having an arcuate seat engagable with only the valley intermediate said pair of ridges in opposing relationship to the one die at the throat of the bend angle, the movement means for moving the dies one relative to the other so as functionally to engage the pipe length between the pair of dies and concurrently to reform the configuration of the valley and change the linear spacing between said adjacent ridges to effect a segmental arc bend thereat;

a planar, support surface extending from said bending tool substantially perpendicular to said pair of dies; and fixture means retained on said support surface and engaging said pipe length at said second end, said fixture means for maintaining the pipe second end spaced above the support surface and for controlling the radial position of the pipe around the longitudinal axis of the pipe while the segmental arc bend is effected;

there being additional segmental are bends effected, where necessary, over a consecutive sequence of valleys and ridges of said pipe length directly related to the desired bend angle.

52. The apparatus of claim 51 in which said bending tool includes a body, one of the pair of dies is fixed relative to the body and the other die is moved by the movement means relative to the body and one die, the dies being diametrically opposed to one another.

53. The apparatus of claim 51 in which there is at least one spacer key that is selectively insertable in and removable from between said one die and body to determine the distance that the pair of dies are moved by the movement means and thereby the radius of the segmental arc of bend, when said spacer key is inserted, said dies forming one radius of the segmental arc bend and when removed, said dies forming another radius of the sequential arc bend.

54. The apparatus of claim 51 in which said movement means include a hydraulic ram moving the dies one relative to the other.

55. The apparatus of claim 51 in which the fixture means are slidably retained on said support surface.

56. The apparatus of claim 51 in which the fixture means maintain the pipe second end spaced above the support surface substantially the same distance as the distance from the portion of the pipe engaged in the pair of dies to the plane of the support surface.

57. The apparatus of claim 51 in which the fixture means maintain the pipe ends equally spaced above the plane of said support surface while the segmental arc bend is effected.

58. The apparatus of claim 51 in which the fixture means include radial protractor means for controlling the radial position of the pipe.

59. The apparatus of claim 58 in which said radial protractor means include a disc protractor carrying an indicator member of the radial position of the protractor and thereby the pipe length, memory pins arrangeable around the protractor in at least one concentric circle for indicating the radial positions of the pipe length at which segmental arcs of bend are to be effected, and gear and lever means for selectively fixing the radial position of the disc protractor.

60. The apparatus of claim 51 further including bend angle protractor means abutted against a side of said pair of dies adjacent the first end of said pipe, said protractor means having angle graduations arranged tangential to an arc of a circle passing through said pair of dies, the radius of the segmental arc bend being equal to the radius of the circle and the graduations being sightable over the pipe length, the bend angle protractor means for determining the degree of the bend angle.

61. The apparatus of claim 37 or 51 in which said bending tool includes a body having said pair of dies installed thereon, the dies being diametrically opposed to one another and both dies being movable.

62. The apparatus of claim 37 or 51 in which there is at least one spacer key that is selectively insertable in and removable from between said one die and body to determine the distance into the pipe section that the pair of dies are moved by the movement means and thereby the radius of the segmental arc of bend, when said spacer key is inserted, said dies forming one radius of the segmental arc bend and when removed, said dies forming another radius of the sequential arc bend.

* * * * *